United States Patent [19]

Biersdorff

[11] Patent Number: 4,841,284

[45] Date of Patent: Jun. 20, 1989

[54] INFRARED INTRUSION DETECTION SYSTEM INCORPORATING A FRESNEL LENS AND A MIRROR

[75] Inventor: Jack L. Biersdorff, Los Altos, Calif.

[73] Assignee: C & K Systems, Inc., San Jose, Calif.

[21] Appl. No.: 110,136

[22] Filed: Oct. 19, 1987

[51] Int. Cl.[4] ..... G08B 13/18

[52] U.S. Cl. ..... 340/567; 250/342

[58] Field of Search ..... 340/567; 250/221, 342, 250/349, 353

[56] References Cited

U.S. PATENT DOCUMENTS

| | | | |
|---|---|---|---|
| 3,631,434 | 12/1971 | Schwartz | 340/567 |
| 3,703,718 | 11/1972 | Berman | 340/567 |
| 3,958,118 | 5/1976 | Schwarz | 250/221 |
| 4,364,030 | 12/1982 | Rossin | 340/567 |
| 4,429,224 | 1/1984 | Wagli et al. | 250/342 |
| 4,442,359 | 4/1984 | Lederer | 340/567 X |
| 4,523,095 | 6/1985 | Keller-Steinbach | 250/349 |
| 4,703,171 | 10/1987 | Kahl et al. | 340/567 X |
| 4,752,769 | 6/1988 | Knaup et al. | 340/567 |

*Primary Examiner*—Glen R. Swann, III
*Assistant Examiner*—Thomas J. Mullen, Jr.
*Attorney, Agent, or Firm*—Limbach, Limbach & Sutton

[57] ABSTRACT

In the present invention, an infrared intrusion detection system is disclosed. The infrared intruder detector is typically mounted at a vertical height from a ground plane. The detector has a fresnel lens which has a plurality of lines of focus for focusing infrared radiation received by the detection system through the fresnel lens. A detector in the detection system is located at the focal point for receiving infrared radiation through the fresnel lens. A curvilinearly-shaped mirror is placed apart from the detector in the direction away from the detection plane for receiving infrared radiation from the detection plane and the reflecting and focusing the detected infrared radiation onto the detector.

5 Claims, 5 Drawing Sheets

VERTICAL RANGE

INFRARED INTRUSION DETECTION SYSTEM INCORPORATING A FRESNEL LENS AND A MIRROR

TECHNICAL BACKGROUND

The present invention relates to an infrared intrusion detection system and, more particularly, to an infrared intrusion detection system of the type employing a fresnel lens to focus the infrared radiation from a volume of space and a curvilinearly-shaped mirror to focus the infrared radiation from another volume of space onto the infrared detector.

BACKGROUND OF THE INVENTION

Infrared intrusion detection systems are well-known in the art. Typically, an infrared intrusion detection system comprises a fresnel lens having a plurality of segments, each segment for focusing infrared radiation from a zone in a volume of space onto an infrared detector.

In another prior art passive infrared intrusion detection system, a mirror having a plurality of segments receives infrared radiation from a plurality of spaced apart zones and reflects them and focuses them onto a single detector.

Heretofore, no infrared intrusion detection system has employed the combination of fresnel lenses and mirrors to focus and to reflect infrared radiation from different zones onto a detector, and more particularly, where the fresnel lens focuses the infrared radiation in zones that are "far" away from the detector and the mirror reflects and focuses the infrared radiation from zones that are "near" to the detector.

SUMMARY OF THE INVENTION

In the present invention, an infrared intrusion detection system is disclosed. The system is mounted at a distance displaced from a detection plane. The system has a first fresnel lens having a plurality of lines of focus and a focal point which lies along the line of focus for focusing the infrared radiation. In the improvement of the present invention, the detection system further comprises a detector located at the focal point for receiving infrared radiation from the detection plane focused through the fresnel lens. The infrared intrusion detection system further comprises a curvilinearly-shaped mirror spaced apart from the detector in the direction away from the detection plane for receiving infrared radiation from the detection plane and for reflecting and focusing the detected infrared radiation onto the detector.

BRIEF DESCRIPTION OF THE DRAWINGS

FIG. 3*a* is a top schematic view showing the plurality of spaced apart zones where the infrared radiation from each of the zones is gathered by each of the segments of a fresnel lens.

DETAILED DESCRIPTION OF THE DRAWINGS

Figure 1:
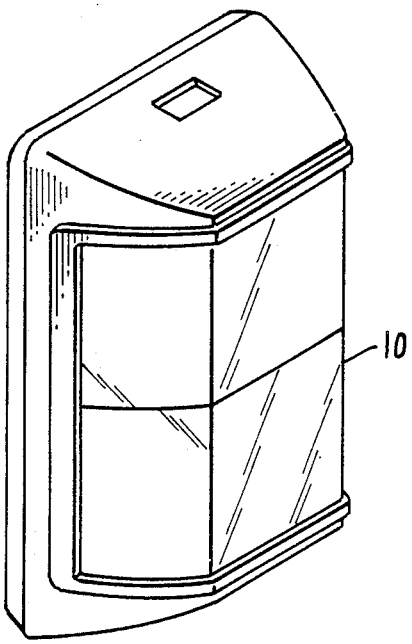
FIG. 1 is a downward perspective view of the outer enclosure, enclosing the infrared intrusion detection system of the present invention.
Figure 4:
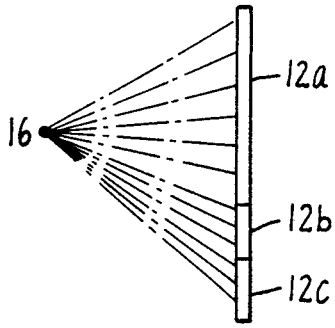
FIG. 4 is an enlarged view of a portion of FIG. 3 showing the plurality of fresnel lenses each with a plurality of lines of focus.
Figure 2:
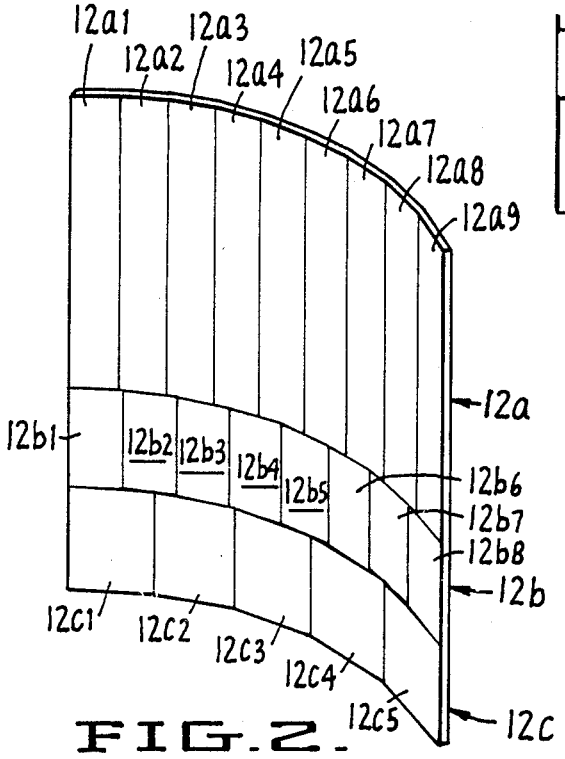
FIG. 2 is a perspective view of a plurality of fresnel lenses contiguously attached, each lens having a plurality of segments, used in the infrared intrusion detection system of the present invention for focusing infrared radiation from a plurality of zones, with each zone passing through a segment of a lens.

Referring to FIG. 1, there is shown a perspective view of an outer enclosure 10 containing an infrared intrusion detection system of the present invention. The enclosure 10 comprises polyethylene, a plastic material, which passes infrared radiation therethrough. Behind the outer covering 10 is a plurality of contiguous fresnel lens 12*a*, 12*b* and 12*c*, shown in greater detail in FIG. 2. Each of the fresnel lenses 12*a*, 12*b* and 12*c* comprises a plurality of contiguous segments designated with the subscript 1, 2, . . . Each of the segments of the fresnel lenses 12*a*, 12*b* and 12*c* has a plurality of lines of focus. The lines of focus of each of the segments $\mathbf{12}a_1 \ldots \mathbf{12}a_9$, segments $\mathbf{12}b_1 \ldots \mathbf{12}b_8$, and segments $\mathbf{12}c_1 \ldots \mathbf{12}c_5$ all intersect at a common focal point 16.

Figure 3:
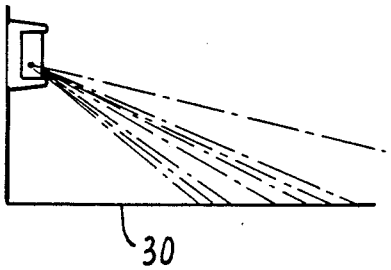
FIG. 3 is a schematic side view of the infrared intrusion detection system of the present invention with the plurality of fresnel lenses and a plurality of lines of focus associated with each lens, mounted vertically displaced from a detection plane.

The infrared intrusion detection system is mounted at a distance displaced from a detection plane 32. Typically, the detection plane 32 is at 3'6" above ground level plane 30 and the intrusion detection system is mounted a distance vertically displaced or above the ground level plane 30. This is shown in FIG. 3. In most applications, a mounting height level of seven feet is adequate.

Each of the segments of each of the fresnel lenses is directed to receive infrared radiation from a zone or volume of space. Each of the volume of space is spaced apart from one another and the infrared radiation from that zone or volume of space is received by a segment of a fresnel lens and is focused at the focal point 16. Referring to FIG. 3*a*, there is shown a plurality of spaced apart zones $\mathbf{18}a_1 \ldots \mathbf{18}a_9$. Each of these zones is collected by a segment $\mathbf{12}a_1 \ldots \mathbf{12}a_9$ and is focused at the focal point 16. Similarly, the zones $\mathbf{18}b_1 \ldots \mathbf{18}b_8$ are collected by the segments $\mathbf{12}b_1 \ldots \mathbf{12}b_8$ and are focused at the focal point 16. Finally, the zones $\mathbf{18}c_1 \ldots \mathbf{18}c_5$ are collected by the segments $\mathbf{12}c_1 \ldots \mathbf{12}c_5$ and are focused at the focal point 16.

Figure 5:
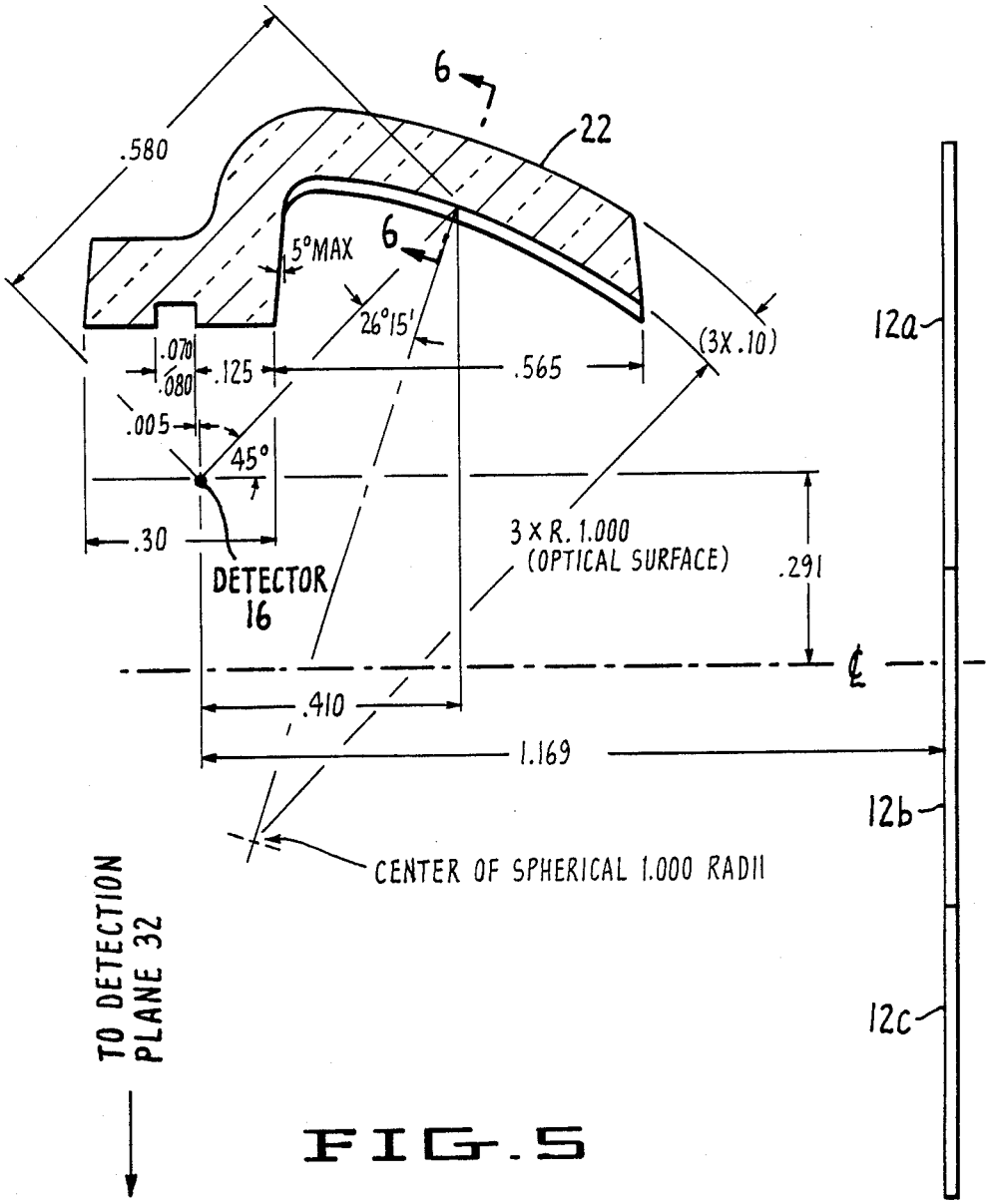
FIG. 5 is a cross-sectional side view showing the relationship between one of the fresnel lenses, the detector, and a curvilinearly-shaped mirror.

Referring to FIG. 5, there is shown schematically a cross-sectional view of a portion of the first fresnel lens 12*a* and a mirror 22 of the infrared intrusion detection system of the present invention. The first fresnel lens 12*a*, 12*b*, and 12*c* and the focal point 16 are shown. A detector, of conventional design, is placed at the focal point 16. Finally, a spherically-shaped mirror 22, having a center located at a position between the focal point 16 and the detection plane 32 and having the dimensions shown in FIG. 5 is located at a distance displaced away from the detection plane 32. The mirror 22 receives infrared radiation from the detection plane 32 and reflects and focuses the detected infrared radiation onto the detector.

Figure 6:
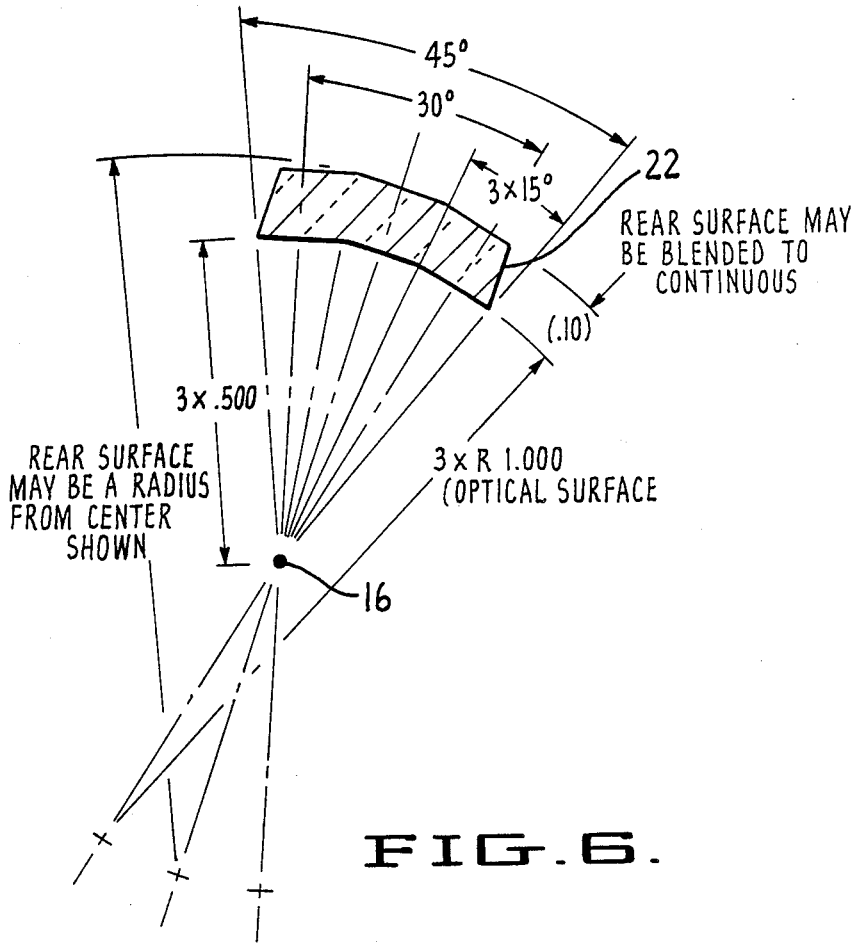
FIG. 6 is a cross-sectional view of the curvilinearly-shaped mirror shown in FIG. 5.

Referring to FIG. 6, there is shown a cross-sectional view of the portion of the mirror 22 shown in FIG. 5. The mirror 22 comprises three segments. Each of the segments receives infrared radiation from a zone spaced apart from one another and reflects that infrared radiation and focuses the radiation onto the detector.

Figure 7:
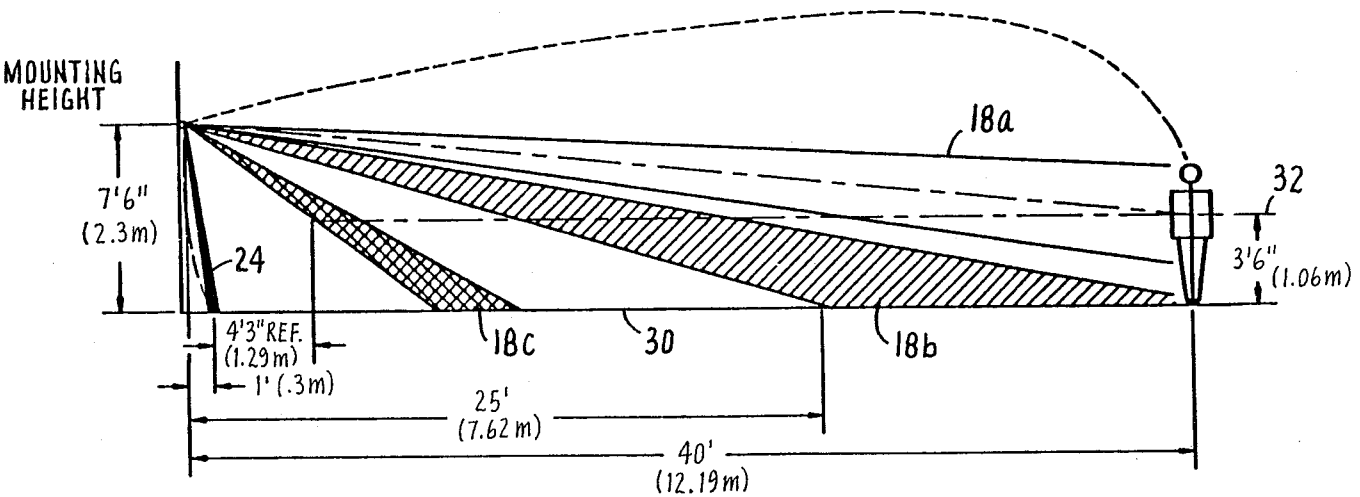
FIG. 7 is a schematic side view showing the plurality of zones where the infrared radiation is gathered and reflected and focused by the lenses and the mirror onto the detector.
Figure 8:
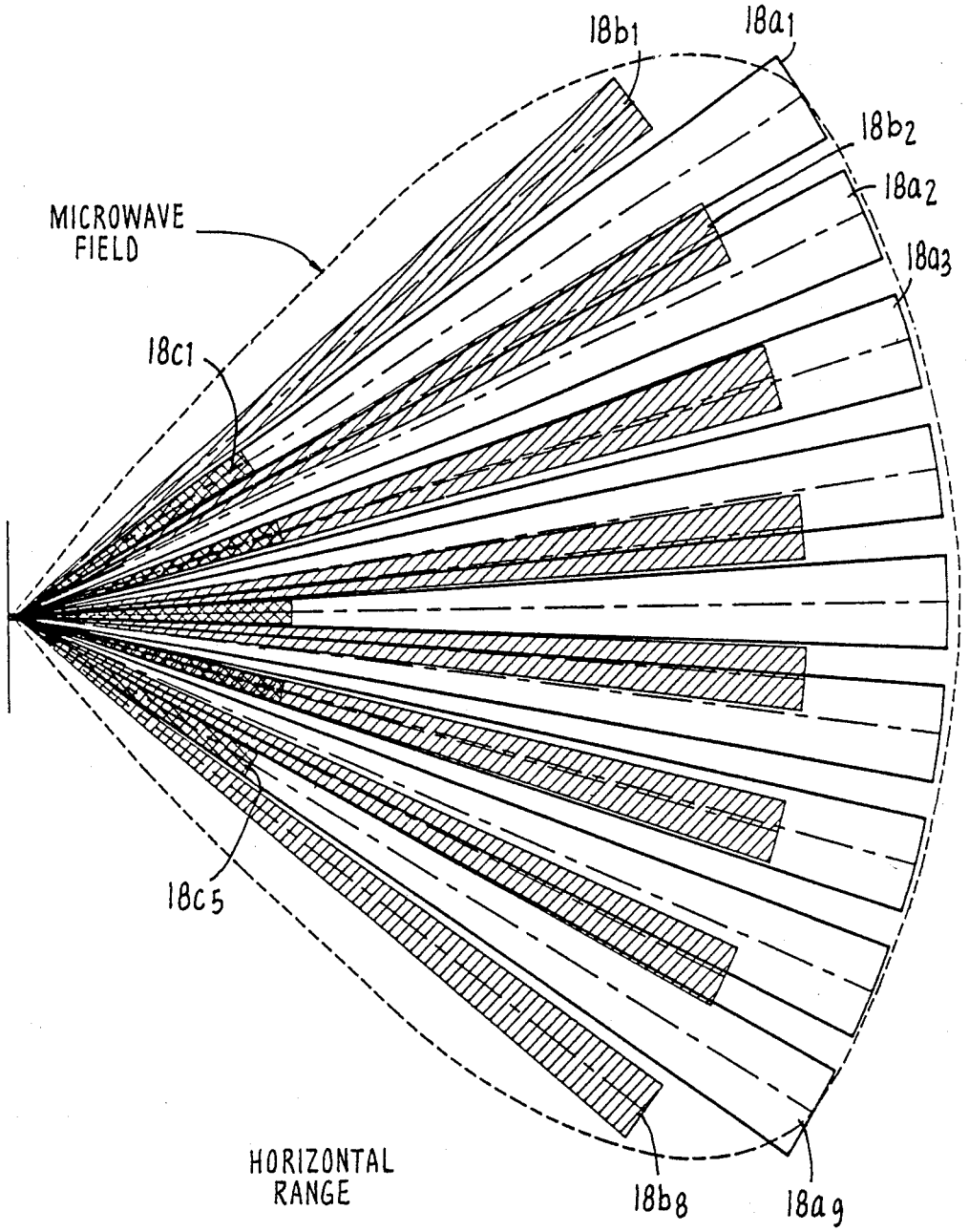

Referring to FIG. 7, there is shown a side view of the zones of infrared radiation detected by the infrared intrusion detection system of the present invention. Zone 18*a* is shown as a zone from the detection plane 32 which passes through the first fresnel lens 12a. Zone 18*b* is detected by the detector at focal point 16 after being focused through the second fresnel lens 12*b*. Zone 18*c* is a zone of infrared radiation focused through the third fresnel lens 12*c* and directed to the detector at focal point 16. Finally, zone 24 is a zone of space where infrared radiation is reflected from the mirror 22 onto the detector at focal point 16.

As can be seen from the drawing in FIG. 7, infrared radiation from zones on the detection plane 32 "far" from the infrared intrusion detection system are focused by the three fresnel lenses 12*a*, 12*b* and 12*c*. Furthermore, the curvilinearly-shaped mirror 22 provides yet an additional zone of volume of space 24 for detecting infrared radiation therefrom, which are in the zone "near" the detection system. This provides greater zones or volumes of infrared radiation detection than heretofore achieved.

What is claimed is:

1. In an infrared intrusion detection system for mounting at a distance displaced from a detection plane, wherein said system having a first fresnel lens having a plurality of lines of focus and a focal point along said plurality of lines of focus for focusing infrared radiation, wherein the improvement comprising:

a detector in said detection system, located at said focal point; and a curvilinearly-shaped mirror means spaced apart from said detector in the direction away from said detection plane for receiving infrared radiation from said detection plane closer to said detector than the infrared radiation focused through said fresnel lens, and for reflecting and focusing said detected infrared radiation directly onto said detector.

2. The detection system of claim 1 further comprising a plurality of fresnel lens, each lens having a plurality of lines of focus and a focal point coincident with the focal point of said first fresnel lens, each of said plurality of lens for focusing infrared radiation from said detection plane farther from said detector than the infrared radiation reflected by said mirror means onto said detector.

3. The detection system of claim 2 wherein each of said plurality of fresnel lens further comprising a plurality of segments for receiving infrared radiation from a plurality of spaced apart zones and for focusing said infrared radiation to said focal point.

4. The detection system of claim 1 wherein said mirror comprises a plurality of segments, each segment for receiving infrared radiation from a zone and for reflecting and focusing said infrared radiation onto said detector.

5. The detection system of claim 1 wherein said mirror is spherically shaped having a center located at a position between said focal point and said detection plane.

* * * * *